US009463393B2

(12) United States Patent
Olivera et al.

(10) Patent No.: US 9,463,393 B2
(45) Date of Patent: Oct. 11, 2016

(54) IMITATING SERPENTINE MOTION IN A MECHANICAL FIGURE

(71) Applicant: Innovation First, Inc., Greenville, TX (US)

(72) Inventors: Raul Olivera, Greenville, TX (US); Jeffrey Russell Waegelin, Rockwall, TX (US); Robert H. Mimlitch, III, Rowlett, TX (US); David Anthony Norman, Greenville, TX (US)

(73) Assignee: Innovation First, Inc., Greenville, TX (US)

( * ) Notice: Subject to any disclaimer, the term of this patent is extended or adjusted under 35 U.S.C. 154(b) by 426 days.

(21) Appl. No.: 13/632,604

(22) Filed: Oct. 1, 2012

(65) Prior Publication Data

US 2014/0094088 A1 Apr. 3, 2014

(51) Int. Cl.

| | |
|---|---|
| ***A63H 11/12*** | (2006.01) |
| ***A63H 11/02*** | (2006.01) |
| ***A63H 13/02*** | (2006.01) |

(52) U.S. Cl.

CPC ..... *A63H 11/12* (2013.01); *A63H 11/02* (2013.01); *A63H 13/02* (2013.01)

(58) Field of Classification Search

CPC ..... A63H 11/02; A63H 11/12; A63H 13/02
USPC ..... 446/278, 330, 351, 353, 434, 457, 458
See application file for complete search history.

(56) References Cited

U.S. PATENT DOCUMENTS 2,035,308 A * 3/1936 Ferber ..... A63H 7/06 446/158
3,196,580 A * 7/1965 Rakestraw ..... A63H 18/007 180/7.1
3,623,566 A * 11/1971 Orloff ..... B62D 57/021 180/7.1
4,219,957 A * 9/1980 Kakuta ..... A63H 18/007 446/230

(Continued)

FOREIGN PATENT DOCUMENTS

GB 2447394 9/2008
GB 2467394 A * 8/2010 ..... A63H 11/12

(Continued)

OTHER PUBLICATIONS

EP Search Report on Corresponding EP Patent Application 12194725.3; Nov. 5, 2013.

(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

In one embodiment there is provided a mechanical device capable of mimicking a serpentine motion. The mechanical device includes a plurality of segmented portions interconnected consecutively at pivoted junctions. A rotational motor and an eccentric weight are secured about one segmented portion and at least one pair of legs extends from a segmented portion towards a contact surface and causes the segmented portion to move in a direction defined as the rotational motor rotates the eccentric weight. The additional segmented portions following the segmented leg portion follow in a serpentine motion as these portions rock and pivot to counter-balance the undulation caused by the segmented leg portion.

32 Claims, 12 Drawing Sheets

(56) References Cited

U.S. PATENT DOCUMENTS

| | | | | |
|---|---|---|---|---|
| 5,628,667 | A * | 5/1997 | Levi | A63H 11/12 446/278 |
| 7,387,179 | B2 * | 6/2008 | Anhalt | B08B 9/045 180/9.1 |
| 7,927,170 | B2 * | 4/2011 | Bickerton | A63H 11/02 446/175 |
| 8,038,503 | B2 * | 10/2011 | Norman | A63H 11/02 446/3 |
| 8,376,804 | B2 * | 2/2013 | Willett | A63H 11/10 446/330 |
| 8,641,472 | B2 * | 2/2014 | Taylor | A63H 11/12 446/368 |
| 8,834,226 | B2 * | 9/2014 | Norman | A63H 11/02 446/351 |
| 2001/0024925 | A1 * | 9/2001 | Domingues | A63H 11/20 446/353 |
| 2002/0111111 | A1 | 8/2002 | Mullaney | |
| 2004/0198159 | A1 * | 10/2004 | Xu | A63H 33/26 446/325 |
| 2012/0100777 | A1 | 4/2012 | Hsu | |

FOREIGN PATENT DOCUMENTS

| | | | |
|---|---|---|---|
| JP | 06343767 | | 12/1984 |
| JP | 06343767 | A * | 12/1994 |

OTHER PUBLICATIONS

Chinese Patent Office Action dated May 20, 2015, co-pending application.

* cited by examiner

IMITATING SERPENTINE MOTION IN A MECHANICAL FIGURE

FIELD OF THE INVENTION

The present invention relates to mechanical devices that have a shifting of a center of gravity based on oscillatory or vibrational motion.

BACKGROUND OF THE INVENTION

One example of vibration driven movement for a mechanical device is the employment of an internal power source and a vibrating mechanism located in or on the mechanical device. The creation of the movement-inducing vibration is to use rotational motors that spin a shaft attached to an eccentric weight. The rotation of the counterweight induces oscillatory forces. Power sources include wind up springs that are manually powered or DC electric motors. The most recent trend is to use pager motors designed to vibrate a pager or cell phone in silent mode. Well known examples include Vibrobots and Bristlebots, both are small mechanical devices that use vibration to induce movement. The mechanical devices would include legs, generally metal wires or stiff plastic bristles. The vibration causes the entire device to vibrate up and down as well as turn in a single direction and therefore drive in a circle. These mechanical devices tend to drift and turn because no significant directional control is achieved.

Beyond the more widely aforementioned vibration driven mechanical devices there are other devices that could utilize an oscillatory motion to mimic a more dynamic form of movement and which would better correspond to its real-life representation. For example, a snake may be one of the most complex animals to mimic movements in a manner that makes the mechanical device life-like. This may be due to the fact that a snake exhibits four different types of movements, Serpentine, Sidewinding, Rectilinear locomotion, and Concertina.

Serpentine—or an S-shape movement, also known as undulatory locomotion, is used by most snakes on land and in water. Starting at the neck, a snake contracts its muscles, thrusting its body from side to side, creating a series of curves. Sidewinding—by contracting their muscles and flinging their bodies, sidewinders create an S-shape that only has two points of contact with the ground; when they push off, they move laterally. Much of a sidewinding snake's body is off the ground while it moves. Rectilinear locomotion—this technique contracts the body into curves, but these waves are much smaller and curve up and down rather than side to side. When a snake uses rectilinear locomotion, the tops of each curve are lifted above the ground as the ventral scales on the bottoms push against the ground, creating a rippling effect similar to how a caterpillar looks when it walks. Lastly, Concertina—the previous methods work well for horizontal surfaces, but snakes climb using the concertina technique. The snake extends its head and the front of its body along the vertical surface and then finds a place to grip with its ventral scales. To get a good hold, it bunches up the middle of its body into tight curves that grip the surface while it pulls its back end up; it then springs forward again to find a new place to grip with its scales.

To mimic a snake's horizontal movement, mechanical devices need to create the appearance of the life-like Serpentine, Sidewinding, and Rectilinear locomotion. While other mechanical devices have attempted to create mechanical snakes, they typically employ very complex mechanical linkages, gear trains, wheels and multiple motors. There therefore exists a needs to simplify the components while maintaining a high-degree of life like movement.

SUMMARY OF THE INVENTION

In one embodiment of the present invention there is provided a mechanical device having a plurality of segments interconnected consecutively at pivots formed between two adjacent segments. The plurality of segments further define at least a front section and a rear section, wherein a section can include one or more segments. A rotational motor and an eccentric weight are secured about one of the segments. At least one pair of legs extend from one of the segments towards a contact surface, defining a first leg segment, and the legs are configured to cause the first leg segment to move in a direction as the rotation motor rotates the eccentric weight. The movement of the first leg segment acts to pull or push the other interconnected segments therewith.

Other aspects of various embodiments include the first pair of legs and the rotational motor with the eccentric weight being positioned about the same segment. This particular segment with the first pair of legs and rotational motor/eccentric weight may also be the front segment. With respect to the front segment having a first pair of legs, in another embodiment, another pair of legs can be provided in the front segment, such that the legs form rows of legs extending about either side of the front segment.

In yet other embodiments, the mechanical device further includes at least a second pair of legs extending from another segment towards a contact surface, and defines a second leg segment. The second leg segment and the first leg segment would be interconnected to one another by including at least one other segment interconnected therebetween.

The mechanical device may also include a power source and a switch. The switch interconnecting the power source to the rotational motor for selectively providing power to activate and deactivate the power source. In one aspect, the power source can be positioned in a segment, defining a power source segment. And the switch can be positioned in a separate segment, defining a switch segment. The power source segment can then be interconnected along the plurality of segments between the first leg segment and the second leg segment. In addition, the switch segment can be interconnected along the plurality of segments between the power source segment and the second leg segment. In yet other embodiments the switch and/or the power source can be combined into one segment. The switch and/or power source could also be combined with the segment containing the motor.

As further defined in various embodiments, the mechanical device may include a head segment, a tail segment, a middle leg segment, and a set of forward segments between the head and middle leg segments and a set of rearward segments between the middle leg segment and the tail segment. Legs may be provided in or near the head segment and at the middle leg segment; with a rotational motor and eccentric weight positioned at or near the head segment. The front set of legs may or may not be positioned in the same segment as the rotational motor and eccentric weight.

In essence, one or more of the embodiments presented herein provides for a rotational motor to generate forces to move a first leg segment along a surface and a forward and rearward set of segments, separated by a second leg segment, are configured to freely pivot about pivot points allowing an undulation of a center of gravity of the mechanical device thereby oscillating the segments to create an appearance of a serpentine motion.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1A:
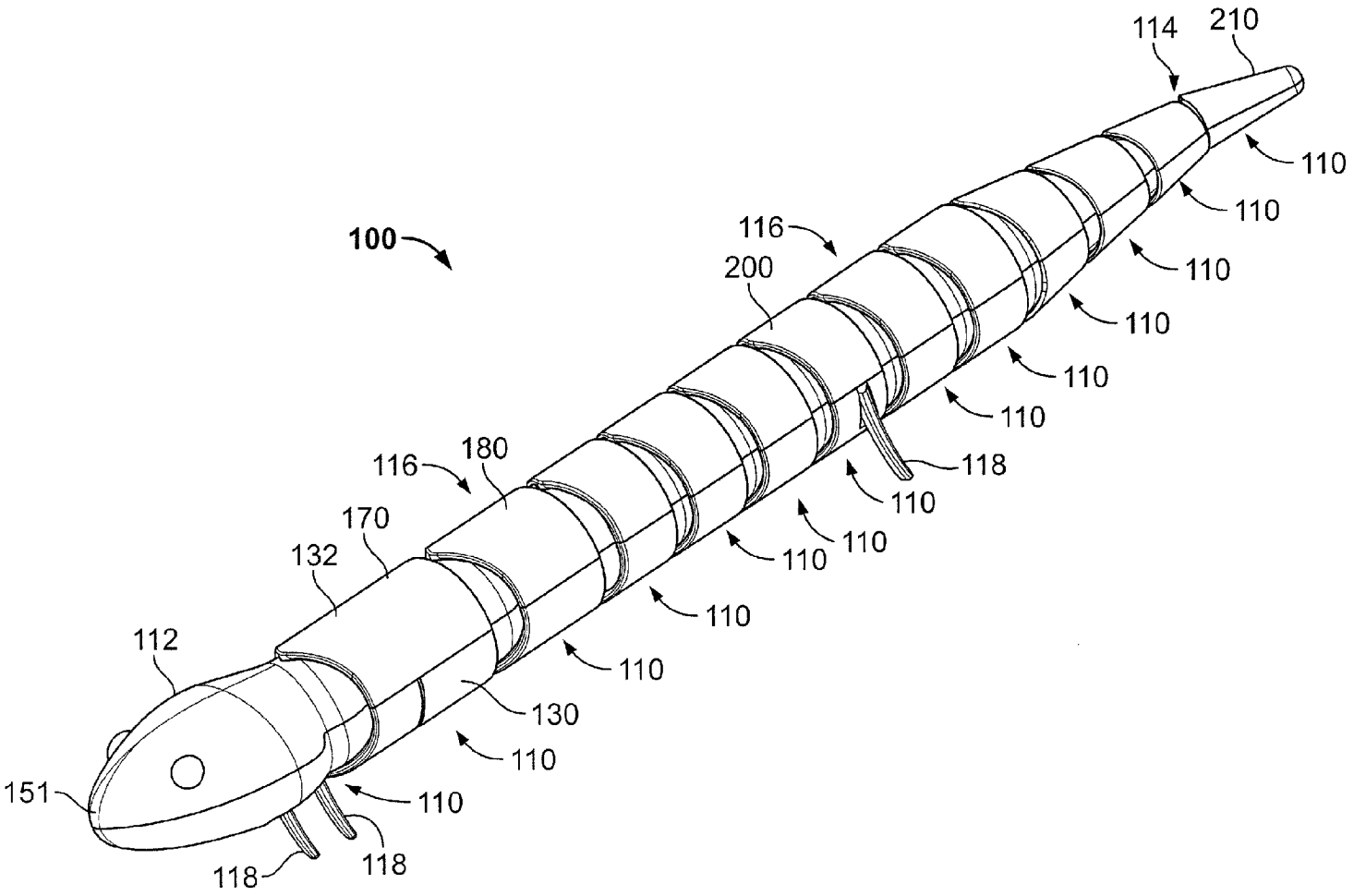
FIG. 1A is a perspective view of a mechanical device in accordance with an embodiment of the present invention.

While the invention is susceptible to embodiments in many different forms, there are shown in the drawings and will be described in detail herein the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1 and as provided in but one embodiment of the present invention there is provided a vibration-powered mechanical device 100 that appears to be have a long, narrow-like body shape, similar to a snake. As will be explained herein below, the mechanical device has segments that define various sections that oscillate between various movements to create a serpentine-like motion. The mechanical device 100 is designed to move across a surface, e.g. a floor, table, or other relatively flat surface. The mechanical device 100 is adapted to move autonomously and, in some implementations, turn in seemingly random directions.

In general, the mechanical device 100 includes a segmented body, that defines a front section 112, a rear section 114, and intermediate sections 116 positioned between the front and rear sections. Each section can include one or more segments 110. The mechanical device further includes multiple legs 118 and a vibrating mechanism. The vibrating mechanism can be either a motor or spring-loaded mechanical winding mechanism, either of which would rotating an eccentric weight, a motor or other mechanism adapted to induce oscillation of a counterweight, or other arrangement of components adapted to rapidly alter the center of mass of at least a portion of the mechanical device). As a result, the mechanical device 100, when in motion, resembles a snake, worm, or other similar type animals or insects.

Movement of the mechanical device 100 can be induced by the motion of the rotational motor inside of, or attached to, the device 100, in combination with a rotating eccentric weight with a center of mass that is offset relative to the rotational axis of the motor. The rotational movement of the weight causes the motor and at least a portion of the mechanical device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor) using legs that are configured to alternatively flex (in a particular direction) and return to the original position as the vibration causes the device to move up and down.

Various features can be incorporated into the mechanical device. For example, U.S. patent application Ser. No. 12/860,696, entitled "Vibration Powered Vehicle", filed Aug. 20, 2010, which is incorporated herein by reference in its entirety, discusses in greater detail different features and their effect on other mechanical devices but which can be employed in the current application as well. Some of which include the implementation of mechanical device features for facilitating efficient transfer of vibration to forward motion, such as the shape of the legs, number of legs, frictional characteristics of the leg tips, relative stiffness or flexibility of the legs, resiliency of the legs, relative location of the rotating counterweight with respect to the legs, etc. In addition, the speed and direction of the mechanical device's movement can depend on many factors, including the rotational speed of the motor, the size of the offset weight attached to the motor, the power supply, the leg characteristics (e.g., size, orientation, shape, material, resiliency, frictional characteristics, etc.) and their attachment to the housing of the device, the properties of the surface on which the device operates, the overall weight of the device, and so on.

These and other embodiments can each optionally include one or more of the following features. The apparatus includes fewer than twenty legs that contact a support surface as the at least one diving leg causes the apparatus to move. The legs are tapered. A diameter of each driving leg is at least 5% of the length of the leg. The legs are curved. The legs are constructed from an elastomeric material. The flexible material includes rubber. The flexible material includes an elastomer. The at least one driving leg is configured to cause the apparatus to repeatedly hop as the rotational motor rotates the accentric load. The at least one driving leg is curved between the leg based and the leg tip. The eccentric load is configured to be located toward a front end of the apparatus relative to the driving legs, wherein the front end of the apparatus is defined by an end in the direction of movement. The repeated hopping causes the apparatus to move in the direction generally defined by an offset between the leg based and the leg tip. The legs include at least two legs adapted to cause the apparatus to move. The at least one driving leg includes a durometer in the range of approximately 55-75, based on the Shore A scale. The eccentric load includes an inertial load adapted, when the eccentric load is rotated by the rotational motor, to cause the at least one driving leg to hop off a flat support surface. The at least one driving leg is constructed from polystyrene-butadiene-styrene. The at least one driving leg has a ratio of a leg length to a leg diameter in the range of 2.0 to 10.0. The thickness of the legs is defined by a diameter of approximately 5.25 times less than the length of the leg. A curvature of the legs is adapted to enhance a tendency of the apparatus to move in the direction generally defined by the offset between the leg base and the leg tip. The curvature of the legs in combination with a resiliency of the legs are adapted to allow the legs to maintain an approximately neutral position when the rotational motor is not rotating the eccentric load and to bend in a direction of the curvature when a rotational movement of the eccentric load introduces a downward force on the apparatus. The neutral position is defined by a shape of the legs when not supporting a load. A relative stiffness of at least two specific legs of the plurality of legs is configured to alter a tendency of the apparatus to turn.

Figure 1B:
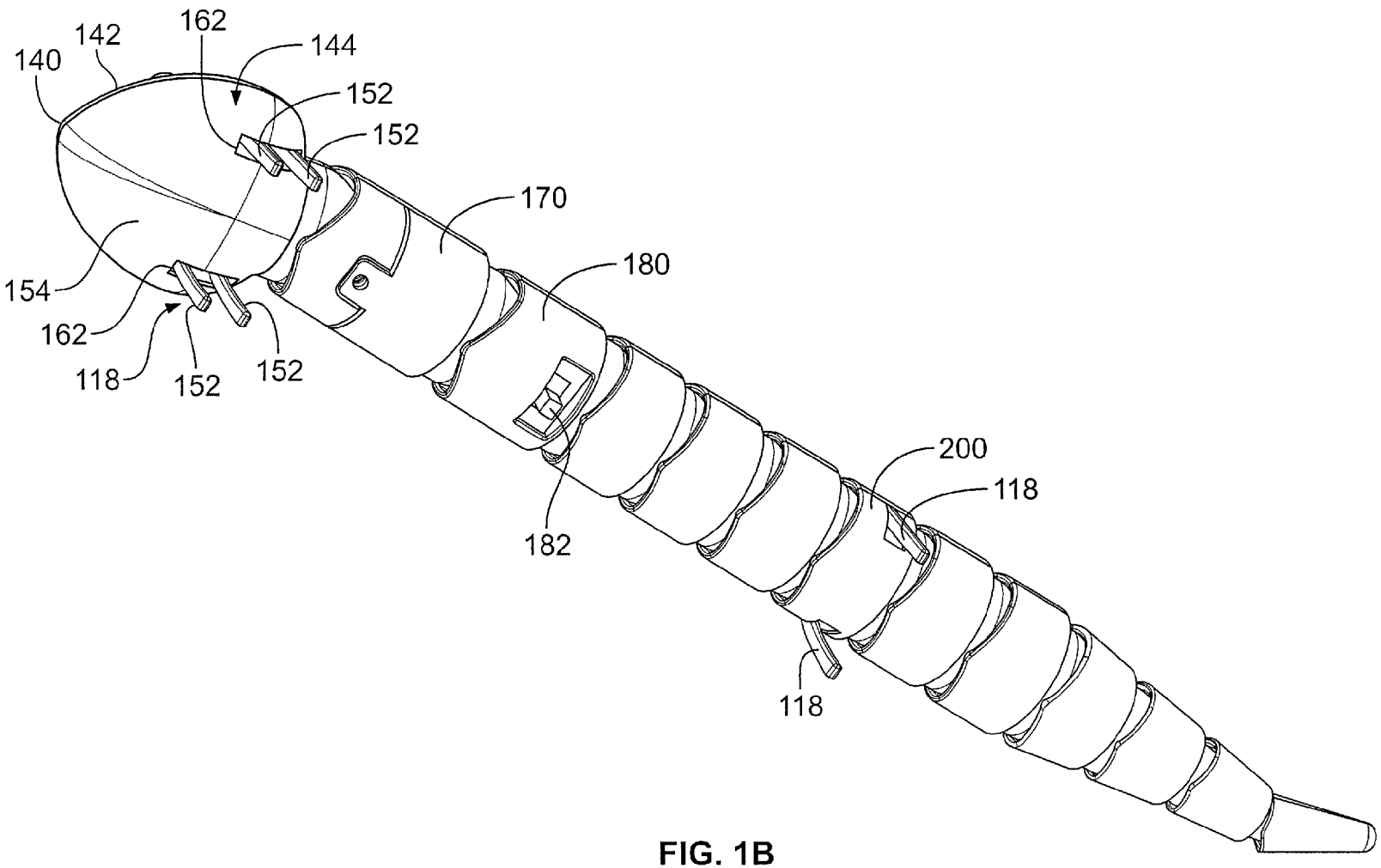
FIG. 1B is a perspective underside view of the mechanical device of FIG. 1A.
Figure 1C:
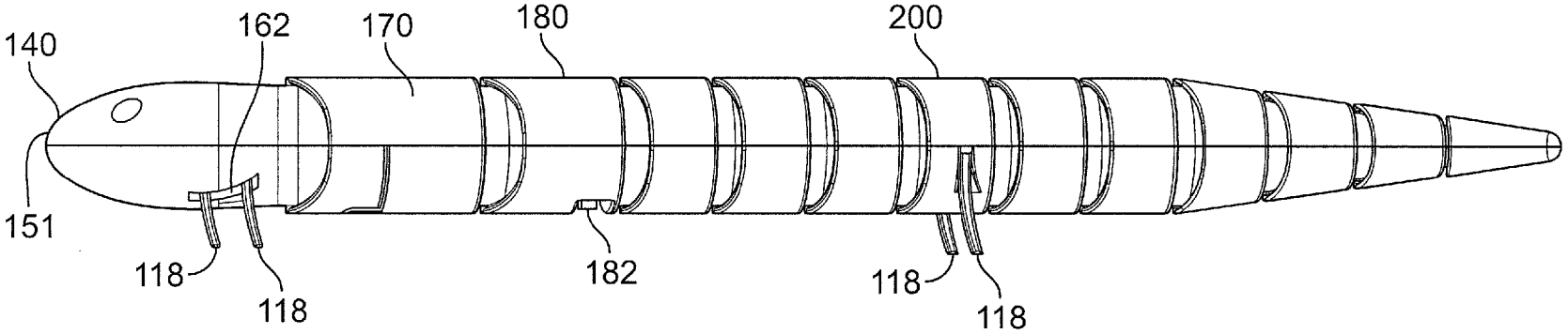
FIG. 1C is a side view of mechanical device of FIG. 1A.

Referring to FIGS. 1A through 1C, the mechanical device 100 is provided with a plurality of segments 110. As noted above, the segments 110 include at least a front segment 112, representing the head of the device, a rear segment 114, representing the tail of the device, and a plurality of intermediate segments 116 positioned between the front and rear segments. Each segment 110 includes a bottom housing section 130 and a top housing section 132 which are fitted together. When assembled, an adhesive, glue, ultrasonic weld, or other type of fastening means can be used to maintain a connection between the two housing sections.

Figure 2:
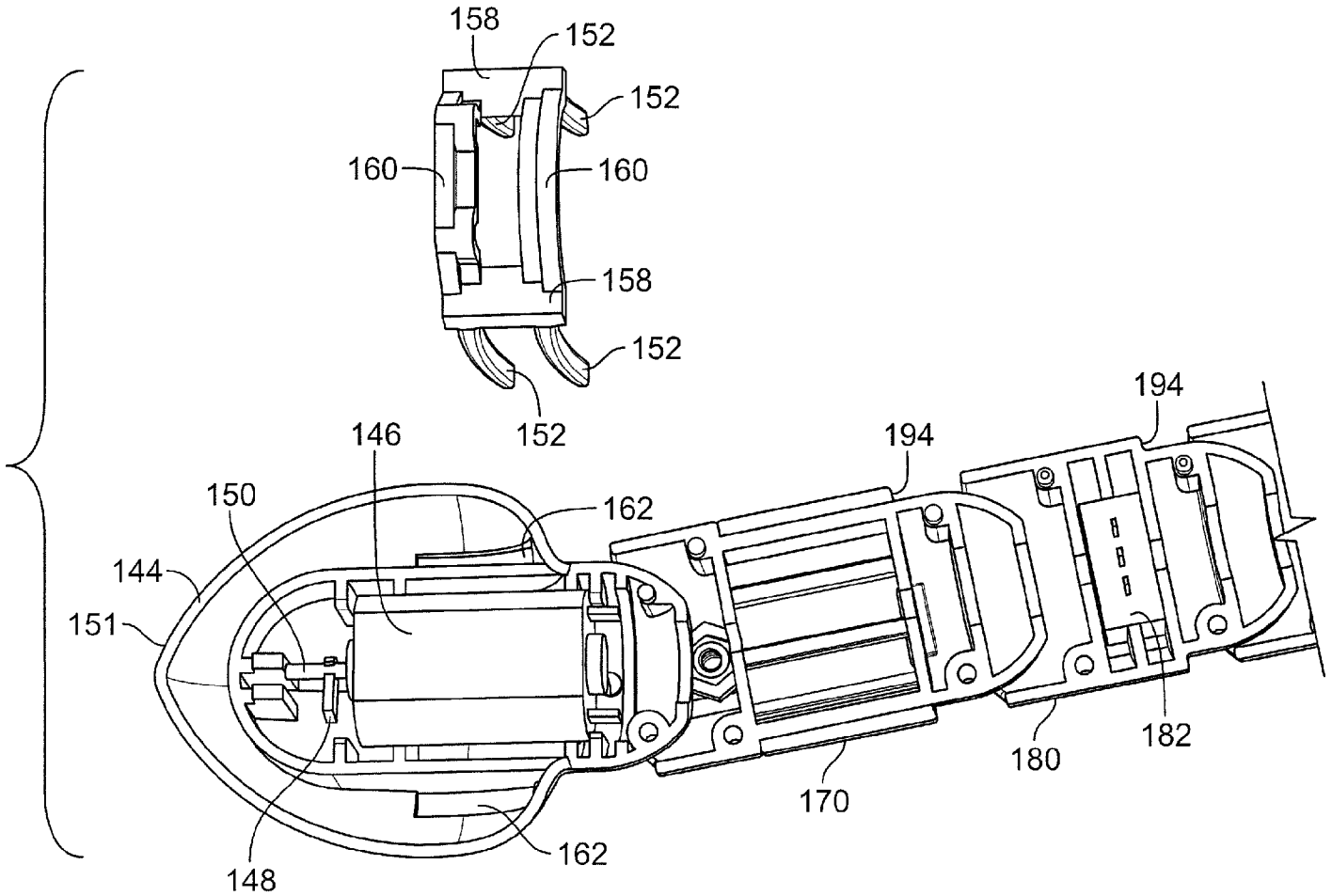
FIG. 2 is a partially exploded and enlarged view of a frontward section of the mechanical device.
Figure 3:
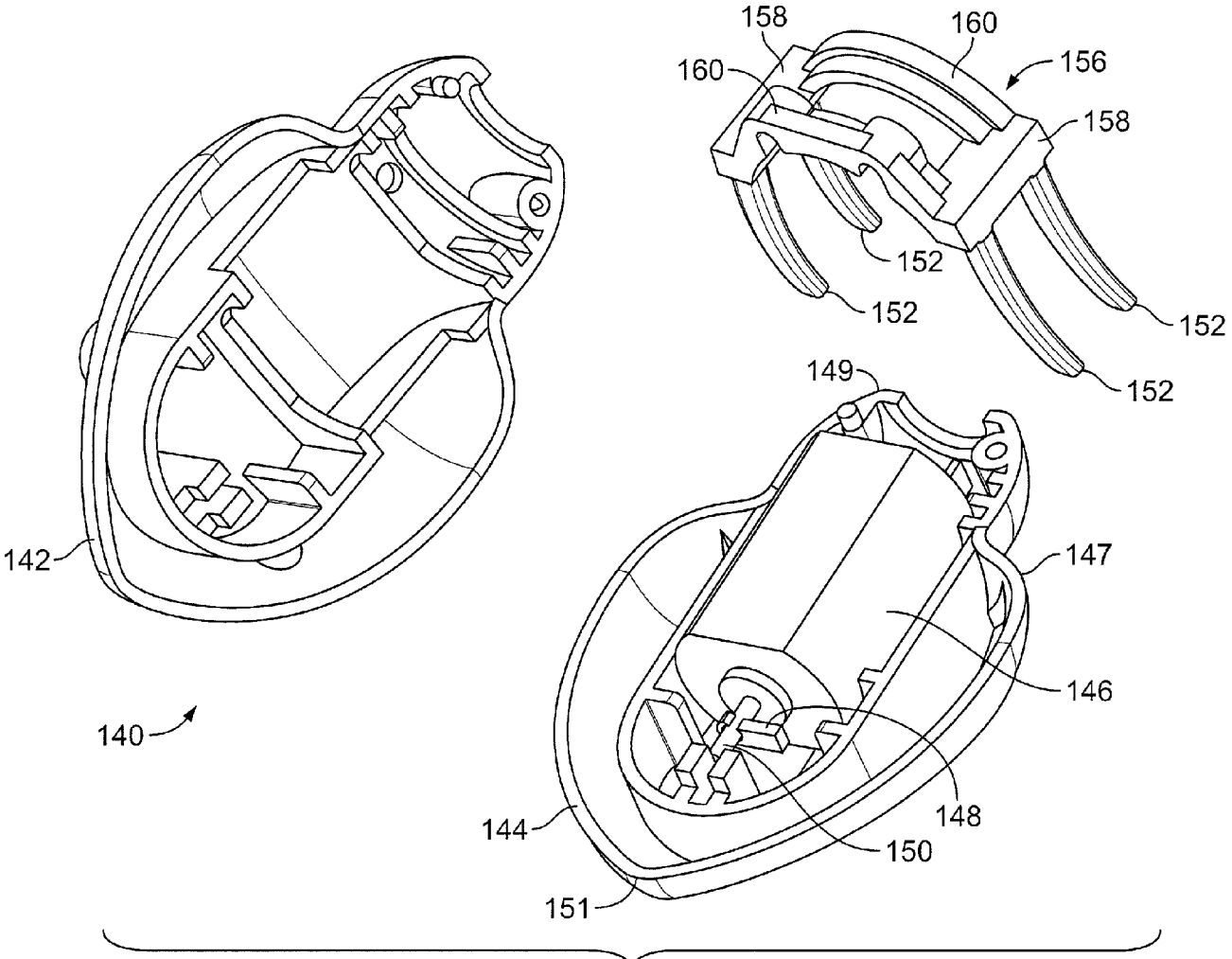
FIG. 3 is an exploded view of the front segmented portion of the mechanical device.

Referring now to FIGS. 2-3, the front segment 112, or the head assembly 140 of the mechanical device 100, includes an assembled housing having at least a top section 142 and a bottom section 144. As further explained below, the front segment 112 includes an exterior profile that tapers 147 inwardly towards the back portion 149 of the housing.

The head assembly 140 includes a rotational motor 146 driving an eccentric weight 148 with a center of mass that is offset relative to the rotational axis 150 of the motor 146. At least one leg 152 is positioned to extend away from the head assembly below an underside exterior 154 of the bottom section 144. The at least one leg 152 may be secured to the underside exterior 154, to the side of the head assembly 140, to an interior portion of the head assembly, or within the head assembly. The head assembly can further include a tip 151 or nose portion defined along the perimeter of a front of the head assembly. When moving the tip 151 is provided to help deflect the head assembly when the snake encounters an obstacle. If the mechanical device hits an object the head assembly, being secured to the other segments 110 by a free pivot (discussed in greater detail below), the head assembly driving in a forward motion by the rotational motor will have a tendency to turn or deflect to one side. This in turn will cause the mechanical device to begin to turn away from or move around the object. In some instances the mechanical device will appear to curve around the object while in other instances the mechanical device will appear to turn away from the object altogether and move in a completely new direction.

In another embodiment, the at least one leg 152 may include a pair of legs extending from either side of the rotational motor 146. Each pair of legs may be attached to a saddle 156. The saddle 156 secures each pair of legs 152 to a saddle base 158. The two saddle bases 158 are attached to one another by one or more supports 160. The supports 160 may be arched such that the saddle 156 can be positioned over the motor 146. The legs 152 would then extend through separate openings or a slotted opening 162 in the bottom section 144.

Figure 4:
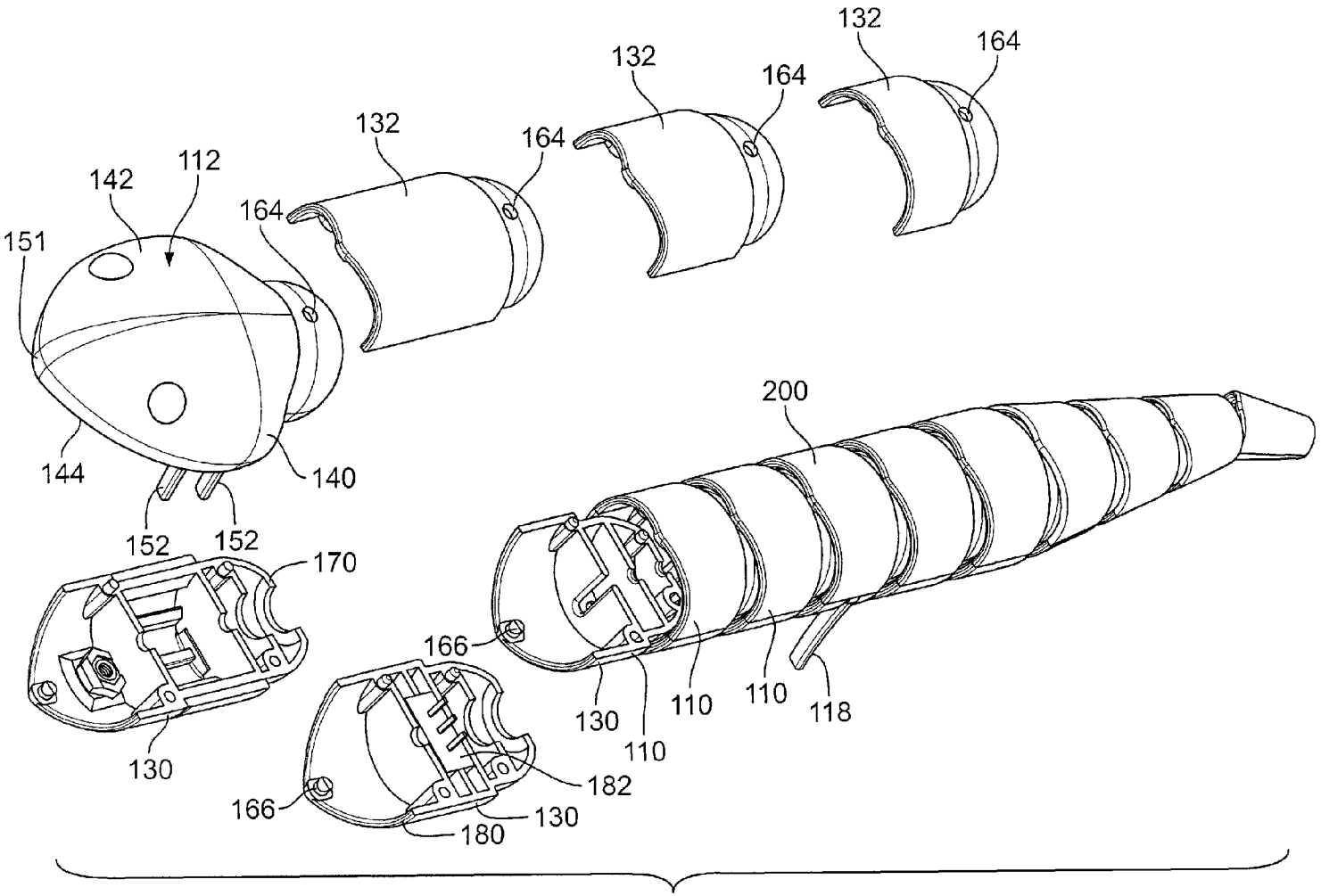
FIG. 4 is a partially exploded view of segmented portions of the mechanical device.

The segments, including the front segment 112, are each freely pivotally connected to each other, such that no further linkages, gears, or other mechanical components are provided between the segments, with the exception of electrical wires as necessary. This is more easily shown in FIGS. 4, 5 and 7. The back portion of each segment 110 (absent the last or rearmost portion 114) includes either a notch or tab 164 which correspondingly fits with a receiving tab or notch 166 provided in the forward portion of each segment 110 (except the first or front segment portion 112). One aspect of the present invention is that the segments 110 can include low friction pivots to help allow the segments 110 to exhibit movements representative of life-like creatures. The low friction pivots can be a property of the plastic or other material used to manufacture the mechanical device or could require polishing of the material to ensure a low friction pivot. Other low frictional pivots can easily be employed with the present invention, for example a pin and detent, or ball and socket type pivot can be used.

Along with the front segment 112 used to house the motor 146, eccentric weight 148, and the at least one front leg 152, other segments are provided to specifically house other components. For example, a power source segment 170 is used to house a power source, such as batteries. The power source segment 170 would most likely include a door 172 that the user can open and secure closed to have easy access to the batteries or other power source. If the power source is a set of rechargeable batteries, then the door 172 can be an access port allowing the user to plug the mechanical device into an outlet or other type of recharging station. In addition, an on/off switch segment 180 can be employed to house a toggle switch 182 that a user can switch the power to the motor on and off.

Figure 5B:
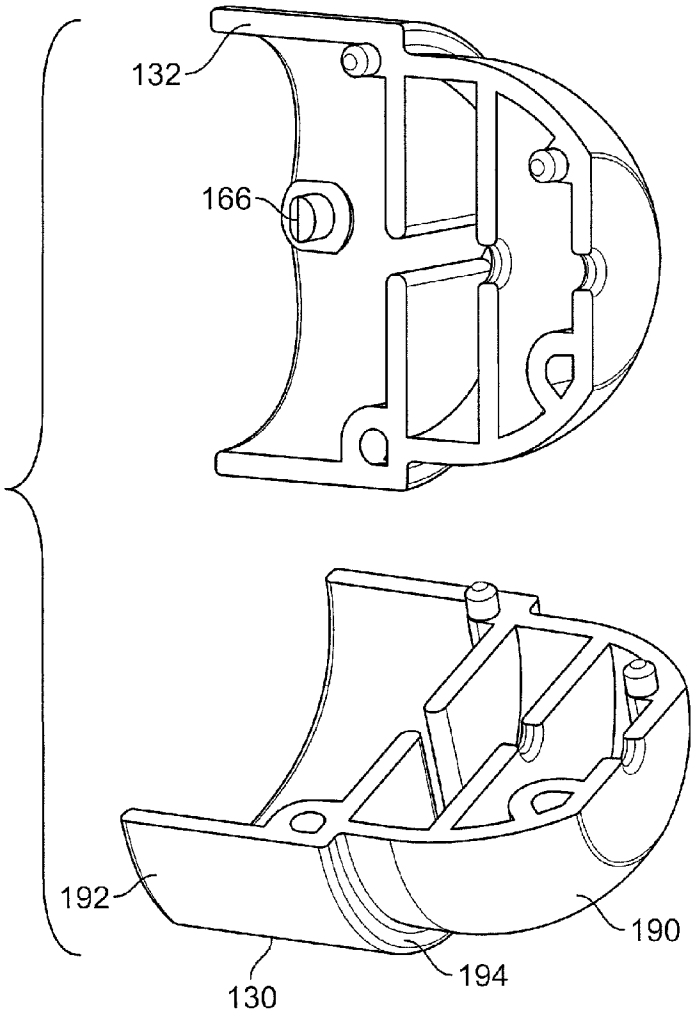
FIG. 5B is an exploded view of the intermediate segmented portion from FIG. 5A.
Figure 5A:
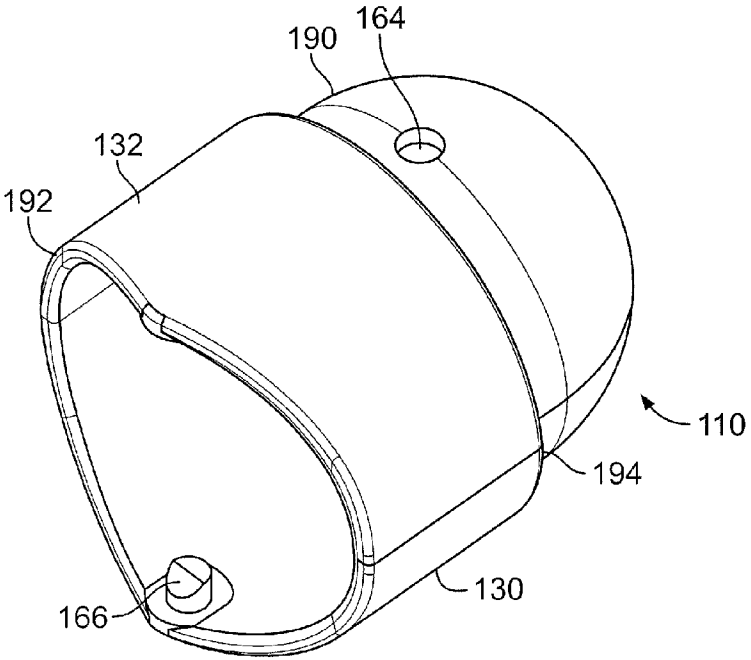
FIG. 5A is a perspective view of an intermediate segmented portion of the mechanical device.

Referring now to FIGS. 5A and 5B, there is shown an intermediate section 116 formed from multiple segments, each having a bottom housing section 130 and a top housing section 132. As noted above, the back portion 190 includes either a notch or tab 164 which correspondingly fits with a reciprocating tab or notch 166 provided in the forward portion 192. In addition, to help pivot the intermediate segmented portions together, the back portion 190 has a smaller perimeter than the forward portion 192. This may be employed with a tapered or inwward transitioning edge 194 between the back and forward portions. This allows the back portion 190 of a forward segmented portion to fit easily within the front portion of the segmented portion that follows.

Figure 6A:
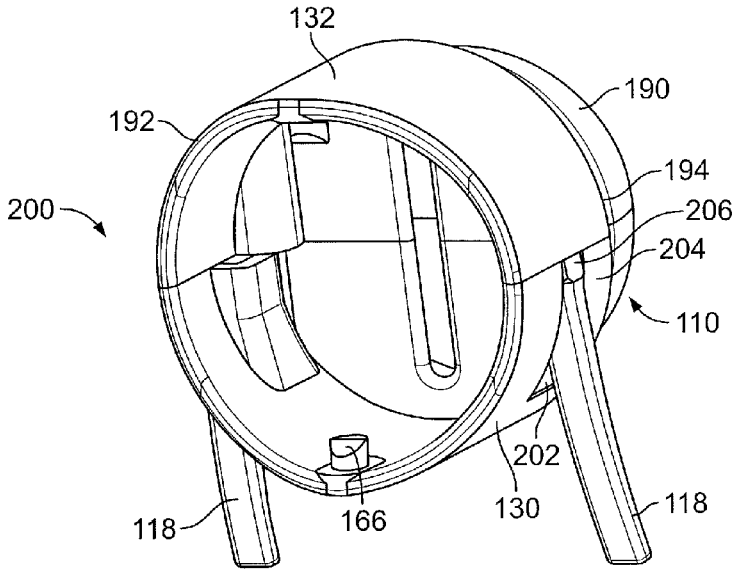
FIG. 6A is a perspective view of an intermediate segmented portion with legs.
Figure 6B:
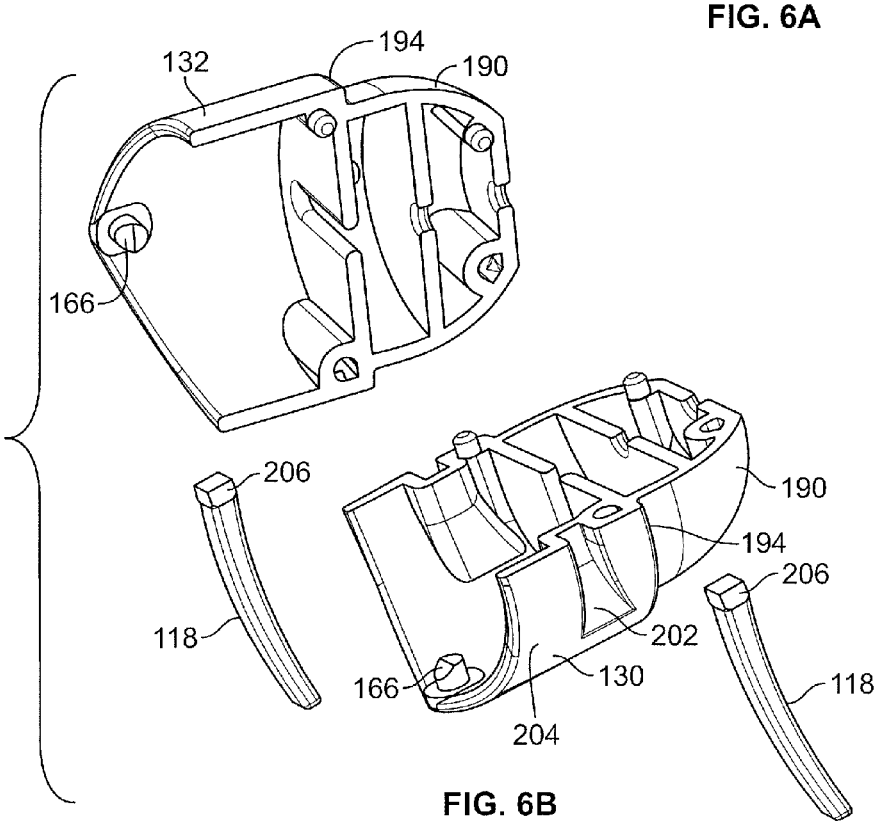
FIG. 6B is an exploded view of the intermediate segmented portion with legs from FIG. 6A.

Referring also to FIGS. 6A and 6B, there is further provided a middle or second leg segment 200 constructed similarly to the aforementioned segments 110 except this second leg segment 200 further houses at least one leg 118. The at least one leg 118 is secured to a portion of the housing and may be either to the interior or exterior portion of the housing. The at least one leg may be as illustrated at least one leg on either side of the segmented portion, or include one or more nubs extending from the bottom portion of the segment. In this particular embodiment, a portion of each leg is frictionally fitted in a channel 202 defined on an exterior surface 204 of the bottom housing section 130. leg bases 206 may have a slightly larger diameter to help secure the legs into the channel 202.

However, it can easily been well within the scope of the invention to provide a pair of legs attached to a saddle and positioned within the segmented portion 200 with the legs extending through one or more slots on the bottom housing section 130. In addition, the legs could be secured to apertures or openings that permit the legs to be adjustable either laterally or rotationally.

As also illustrated throughout the figures, the rear segment 114 may have a tapered exterior surface 210 to provide the appearance of a tail or end of the snake or worm. Furthermore, as opposed to being the last segmented portion, the rear segment 114 may refer to being a rear section that includes one or more segments positioned towards the aft of the mechanical device. As such the tapered exterior surface 210 may appear in more then one segment. Along a similar process, the front segment 112 may infer to more then one beginning segment, such that a head and maybe a neck segment are included in the reference to a front section of segments.

There are numerous variations that can be employed with the present embodiments. First, a plurality of legs can be further added, for example one or more legs can be added to each segmented portion. The legs could also be facing various directions which may be set during manufacturing or adjustable by the user. In addition, the rotational motor could be moved from the front segmented section to an intermediate segmented section or even the rear segmented section. As such the rotational motor is moved such that the forward movement of the mechanical device is changed from a pulling motion to a pushing motion. However, minimizing the number of legs and placing the motor to the front was found to be one embodiment that provided movement that resembled a snake.

In another embodiment, the mechanical device may include a front segment with a pivot and that moves from one side to another. The head can oscillate side to side by nature of the orientation of the counterweight and the motor, such that the motors rotation axis is parallel to the forward direction of the snake, resulting in up and down forces that provide forward motion, and side to side forces that will make the forward movement vary from straight ahead. The side to side oscillation can also be enhanced by controlling the direction of the motor with electronics. The electronics would switch the rotational motor from rotating the eccentric weight in a first rotational direction to a counter rotational direction. The switching of the rotational direction of the eccentric weight can cause the front segment to turn more than running the motor in one direction. Alternating the rotational would allow the mechanical device to turn the front segment from one side and then the other side. Oscillating the front segment back and forth can invoke a rearward oscillation through the mechanical device and provide for a snake like undulatory locomotion.

Figure 7:
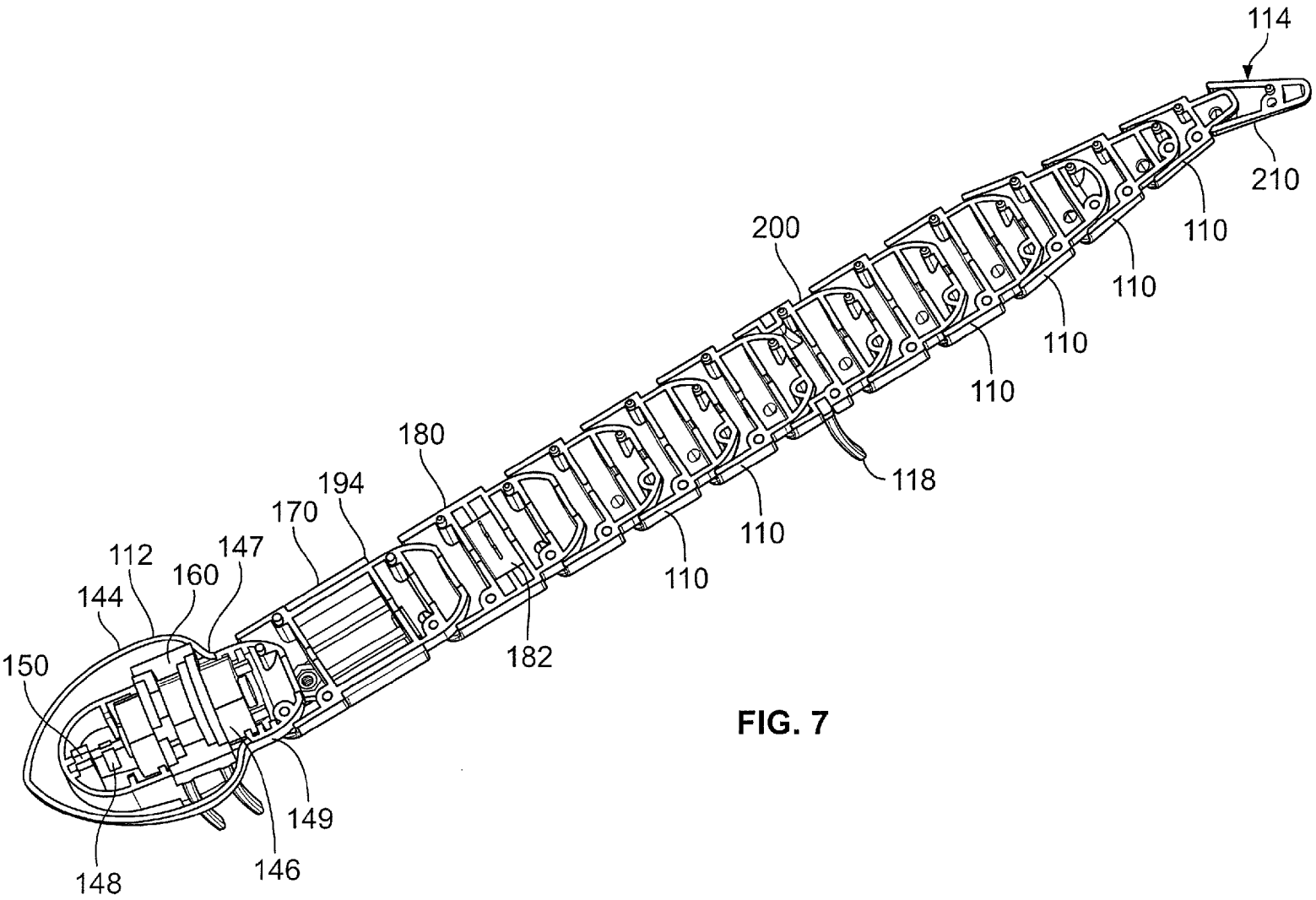
FIG. 7 is a perspective view of the mechanical device without the top housing sections.
Figures 8A, 8B, 8C, 8D, 8E:
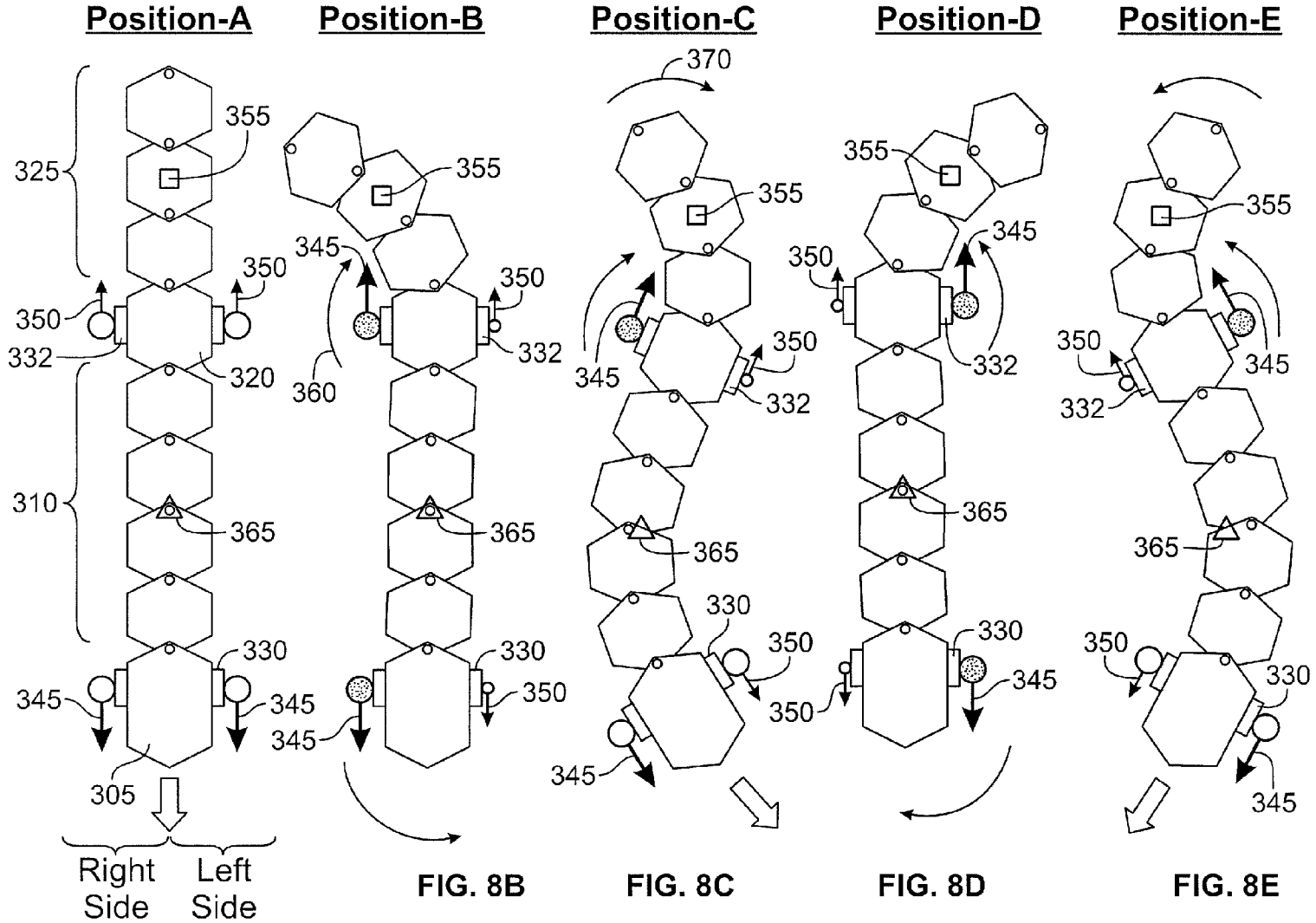
FIGS. 8A-8G are top views of the mechanical device illustrating forces acting on the device and various movements by the mechanical device in response to the forces.
Figure 8G:
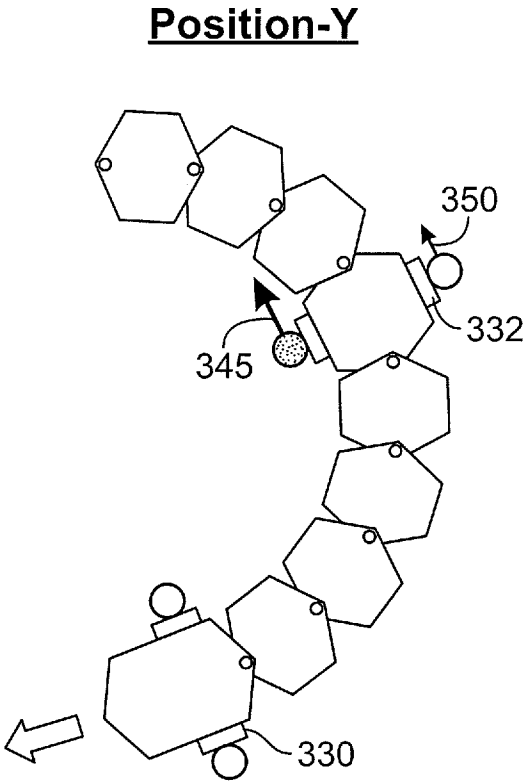
Figure 8F:
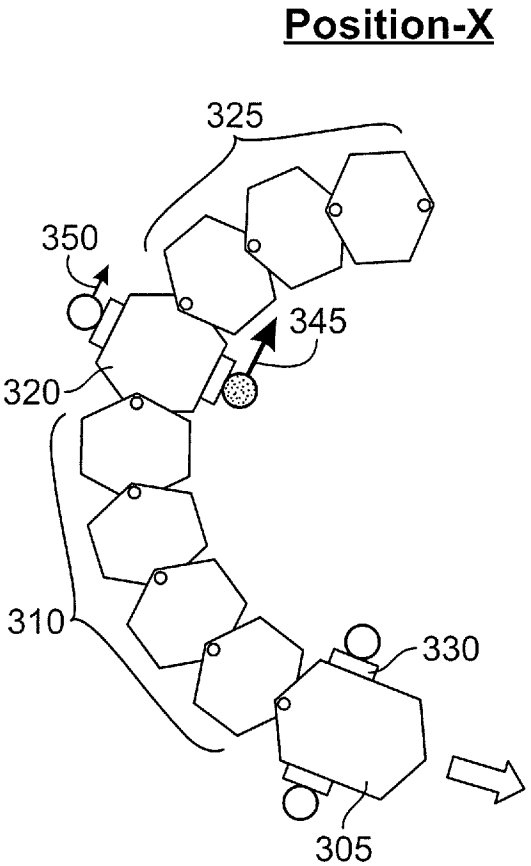

As further illustrated in FIG. 7, the mechanical device 100 in accordance with an embodiment of the present invention is provided to include a front segment 112 that includes at least one leg 118 and a rear segment 114 shaped to form a tail of the mechanical device 100. In addition there is provided a intermediate leg segment 200 positioned between the front segment 112 and the rear segment 114. Additional segment(s) are provided between the front segment 112 and the intermediate leg segment 200 and additional segment(s) are provided between the intermediate leg segment 200 and the rear segment 114. For reference purposes only, the segments between the intermediate leg segment 200 and the rear segment 114 will be referred to as the "rearward segments", while the segments between the front segment 112 and the intermediate leg segment 200 will be referred to as the "forward segments".

There are numerous variations of movement can be employed with the present embodiments. One possible movement of the mechanical device can be illustrated and discussed with reference to FIGS. 8A through 8G. The movement is influenced by various features and forces. As noted above, a low friction hinging point can have an effect on the snake-like movement. Second, the distance between the legs in the front segment to the legs in the intermediate leg segment which is similarly tied to having a certain number of segments between the two can also have an effect on the movement. Lastly, the distance between the intermediate leg segment to the rear segment also has an effect on the movement.

In some embodiments it has been noted, that by not having enough segments between the legs in the front segment and the leg intermediate segment, the mechanical device does not exhibit enough instability to obtain an oscillation on its own. In addition, having too many segments causes the mechanical device to become too unstable during movement that the mechanical device tends to fall over when it begins to curl to one side. As such a proper amount of segments allows the mechanical device to maintain its balance during movement and turning.

In another embodiment of the present invention there is provided a mechanical device that includes a body defined by a head, a tail, and an intermediate body portion between the head and tail. Legs are provided about the head and intermediate body portion. Interposed between the head and intermediate body segment is defined a forward body section, while a rearward body section is defined as interposed between the intermediate body segment and the tail segment. The body may be a single formed body having a flexible exterior or having flexibility defined therein. For example purposes only, the body may be a single contiguous piece of material, such as a plastic or wooden body with curved or grooved notches between portions that permit flexibility there-between. In another aspect the body may be made from segments with pivotal junctions positioned between two interconnecting segments.

The mechanical device further includes a rotational motor and an eccentric weight secured about a portion of the body, and wherein the rotational motor is adapted to rotate the eccentric weight such that vibrational forces are directed through the body. In some aspects the rotational motor and eccentric weight could be positioned forwardly along the body in front of or behind the legs positioned in the head and configured to drive or pull the body in a direction, or positioned rearwardly along the body and configured to push the body in a direction.

As noted legs, such as a first pair of legs are provided about the head and extend towards a contact surface. The first pair of legs are configured to cause the body to move in a direction defined as the rotational motor rotates the eccentric weight. As illustrated the eccentric weight may be in front of the legs or right behind the first pair of legs. For reference purposes this can define a first leg segment. In addition, a second pair of legs are provided and extend from the intermediate section towards a contact surface, defining a second leg segment.

Continuing to refer to FIGS. 8A through 8G, as one embodiment of the present invention there is provided a mechanical device 300 having a head segment 305, intermediate segment 320, a first interposed section 310 positioned between the head and intermediate segment, and a tail section 325 positioned after the intermediate segment. The head segment and intermediate segment include legs 330 that extend downwardly towards a contact surface, referred to as front legs or middle legs. The legs may be as described above. In addition, the middle legs 330 may be replaced with one or more legs or nubs positioned under the section and extending downwardly.

As noted in other embodiments, the sections may be made from one or more segments or may be a single body formed into sections that may pivot or move between sections. Reference to a right side and left side is in reference to the mechanical device's point of view.

The lengths and proportions of the first interposed section 310 and tail section 325 may be important aspects to help define the proper weight distribution that causes instability.

Figure 9:
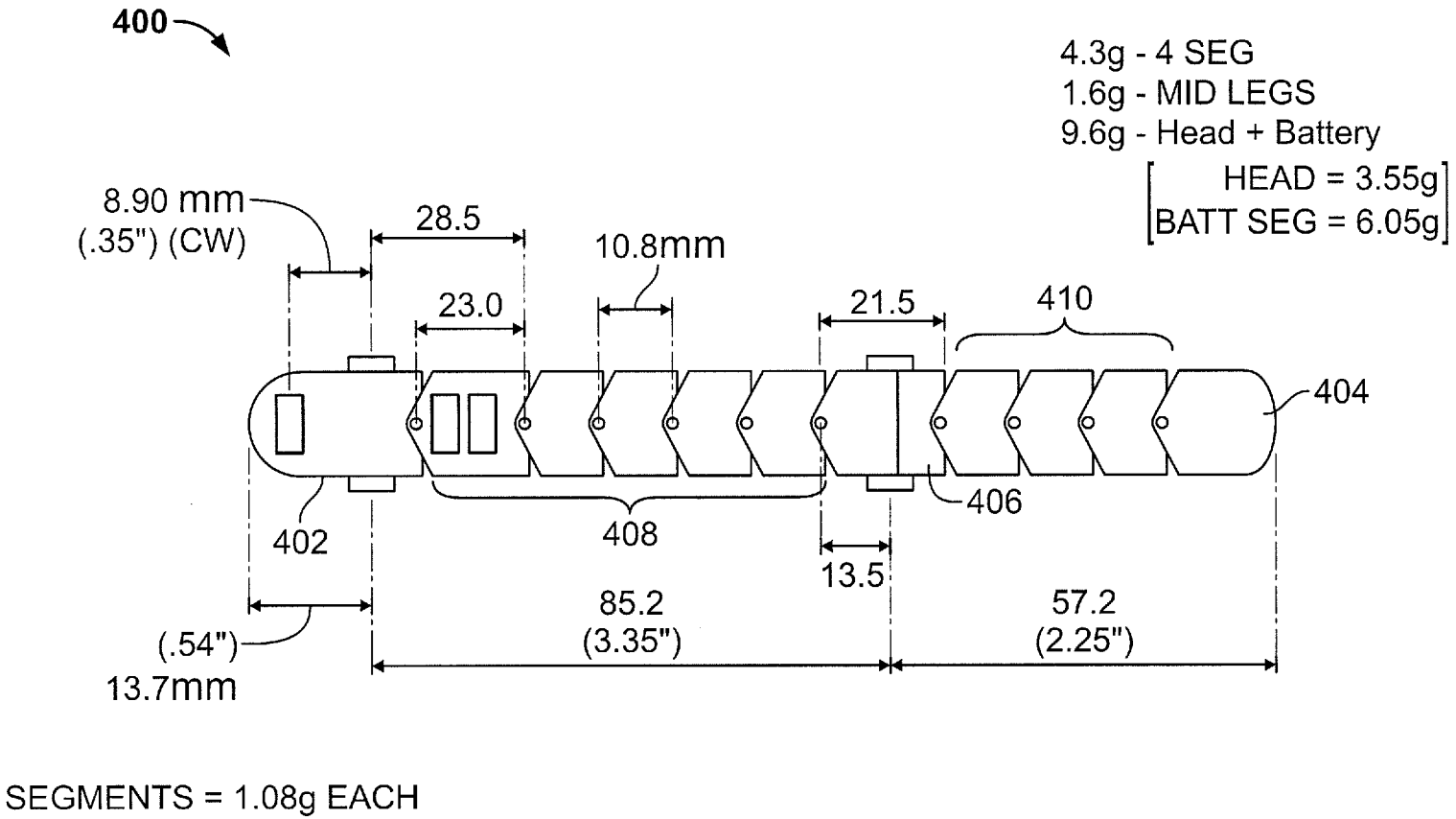
FIG. 9 is a top view of a mechanical device in accordance with one aspect of the invention illustrating various dimensions and weights of the one particular embodiment.

As illustrated in one single embodiment of the present invention FIG. 9, a mechanical device 400 may be provided with a plurality of segments, including a head segment 402, a tail segment 404, a intermediate leg segment 406, a section of segments 408 between the head and intermediate leg segment, and a section of segments 410 between the intermediate leg segment and the tail segment. In this embodiment proper weight distribution and lengths have been measured to provide for a single embodiment that exhibits the movement and motion noted in other examples in the present invention.

The forward motion of the mechanical device is caused by vibration of the head acting on the legs attached to the head. The middle legs vibrate slightly and are able provide forward forces in some instances. However since the driving force of the front legs is much greater, generally the middle legs create a slight drag on the motion in varying degrees. The key aspects of how the mechanical device achieves serpentine-like motion is in the coupling of the oscillating vibration induced driving forces along with the shifting mass of the segments in the intermediate section and tail section.

The positions described below are generalized into a starting position, four common shapes and two uncommon shapes. They are generalized to simplify the discussion since there are an infinite number of shapes as the segments of the mechanical device move. Due to generalizing, each position shown and described actually covers many minor variations as the mechanical device transitions between the positions described. The forces discussed will change and vary continuously due to the wide variety of changing internal and external forces. Therefore, these positions and descriptions are only one possible mode of obtaining a serpentine like motion. Varying the quantity and design of the legs and segments of the snake can change the motion into an infinite number of other possibilities.

Position-A—If the mechanical device starts in position-A, the vertical vibration forces create strong linear forces 345 on the front legs 330 and in a propelling direction and light linear forces 350 on the middle legs 332 in a dragging direction. The horizontal vibration forces will cause the head 305 to vary its direction side to side and the tail 325 will eventually whip to one side or the other as it begins to compensate for the veering.

Position-B—When the tail 325 whips to the right side, the mechanical device is in a reverse "J" shape as shown in position-B. When the mechanical device is in this reverse "J" shape, the center of gravity 355 of the tail 325 shifts to the side to which the tail has shifted. As illustrated in the Position-B diagram, the center of gravity 355 of the tail has shifted to the right side and causes a greater downward force on the legs on the right side; as such the linear forces 345/350 are greater on the right side then the left side. A greater downward force on the head's right side leg when compared to the head's left side leg causes the right side leg to have more forward driving force than the left side leg. The greater driving force from the head's right side leg causes the head 305 to turn to the left (beginning of Position-C). In Position-B, the head's forward driving movement is pulling on the middle leg segment 320, which has greater drag on the right side, causing the middle leg segment 320 to twist clockwise 360.

Position-C—As illustrated in Position-C, the mechanical device starts to curve to the left into an "S" shape. In Position-C, the head's forward driving movement is pulling on the middle leg segment, which has greater drag on the right side, causing the middle leg segment to twist clockwise 360. The center of gravity 365 for the interposed section 310 has shifted to the left side. The tail 325 is angled towards the right side and begins to twist in a clockwise direction 370. The tail center of gravity 355 and interposed section center of gravity 365 causes the overall center of gravity to shift closer to center such that the head 305 is driving straight ahead and trying to straighten out the rest of the segments. The angular twist of the middle leg segment causes the tail to whip to the left side of the snake putting back into a "J" shape as shown in the Position-D diagram.

Position-D—Position-D diagram is a mirror of the Position-B diagram.

Position-E—Position-E diagram is a mirror of the Position-C diagram.

The mechanical device can oscillate between these various positions in a repeating BCDE-BCDE pattern.

Positions X and Y—The amount of tail whip will vary and, in many cases, the amount of angular momentum is great enough to cause the mechanical device to oscillate into an uncommon "C" shape as shown in Positions X and Y. Once in Position X or Y, the forces are fairly balanced on the head and cause the intermediate section to want to straighten out into the "J" shape and thus resume the oscillatory motion.

Obstructions—When the mechanical device runs into an obstruction, the horizontal vibration forces will cause it to steer to one side or another. In cases where the head's forward progress is obstructed long enough, the middle legs slight forward driving force will force the body to twist into a "C" or "S" shape and help the head to steer to one side around the obstruction or out of a corner.

In various embodiment the mechanical device may include a first or front leg segment that is further configured to move the mechanical device in varying directions as the rotational motor generates vibrational forces causing a continuously oscillating shape of the body of the mechanical device.

Other embodiments may have include a body that is configured to move the front and intermediate leg segments in varying directions as the rotational motor generates vibrational forces, causing a continuously oscillating shape of the plurality of segments.

In yet further embodiments, the plurality of segments may be configured to vary the direction of the first and second leg segments as the rotational motor generates vibrational forces, wherein the varying directions of the first and second leg segments causes two or more segments of the body to oscillate from side to side.

In yet other aspects of various embodiments, the first pair of legs is further configured to move the first leg segment in an oscillating direction as the rotational motor generates vibrational forces, and the movement of the first leg segment in the oscillating direction from one direction to another direction generates forces sufficient to change a position of one or more of the interconnected plurality of segments from one side to an other side of the mechanical device, and wherein the changing position of one or more of the interconnected plurality of segments from one side to the other side of the mechanical device further generates forces on the first and second leg segments to change the direction of the first and second leg segments from one direction to another direction, causing a continuously oscillating shape of the plurality of segments.

In yet other aspects of various embodiments, the movement of the center of gravity of the intermediate and tail sections may not be enough force to steer the leg segments and create the serpentine movement. In yet other aspects of various embodiments, the variations in the shapes of the device may not achieve enough variation to appear lifelike. In both of these cases, changes to the movement can be achieved by adding fixed weights inside various segments. Alternately, changes to the movement can be achieved by adding weights inside various segments that are designed to move inside the segment from side to side. These moving weights serve to move the center of gravity of the segment more or less, depending on the position of the weight. Additionally, the shape of the structure below the weight can be shaped in a flat, concave, or convex way, such that the weights movement is altered due to the effects of gravity.

In yet other aspects of various embodiments, the forward driving force of the front legs may need to be increased or decreased, in order to change the balance of forces and to achieve the desired shapes. The forward forces can be changing the durometer, diameter, length, and shape of the legs. Additionally, the amount of drag provided by the intermediate legs may need to be increased or reduced in order to alter the steering of the intermediate segment. The drag can be changed by changing the material of the intermediate legs to one that has higher or lower coefficient of friction with the surface.

From the foregoing and as mentioned above, it is observed that numerous variations and modifications may be effected without departing from the spirit and scope of the novel concept of the invention. It is to be understood that no limitation with respect to the embodiments illustrated herein is intended or should be inferred. It is intended to cover, by the appended claims, all such modifications within the scope of the appended claims.

We claim:

1. A mechanical device comprising:

a body formed from a plurality of segments interconnected consecutively at a pivot, the plurality of segments defining at least a front segment, a rear segment and at least one intermediate segment positioned between the front and rear segments;

the front segment housing a vibrational motor defined by a rotational motor and an eccentric weight, and wherein the vibrational motor is configured to create vibrational forces when the rotational motor rotates the eccentric weight, the front segment further having at least one pair of front legs extending towards a contact surface, defining a front leg segment, and wherein the front leg segment is configured to cause the front segment to move in a direction based on the vibrational forces created as the rotational motor rotates the eccentric weight;

at least one pair of intermediate legs being positioned in the at least one intermediate segment and extending towards a contact surface, defining an intermediate leg segment, and wherein each of the legs from the front and intermediate leg segments has a leg base and a leg tip at a distal end relative to the leg base and wherein the at least one pair of front legs is constructed from a flexible material and each leg of the at least one pair of front legs has an average axial cross-section of at least five percent of a length of the leg between the leg base and the leg tip, and wherein the vibrational motor generates a force that is directed downward and is suitable to deflect the least one pair of front legs to cause the front leg segment and thus the mechanical device to move in a substantially forward direction generally defined by an offset between the leg base and the leg tip as the rotational motor rotates the eccentric weight, and wherein the rear and intermediate leg segments being interconnected consecutively at the pivots are configured to move in varying directions as the rotational motor generates the vibrational forces, causing a continuously oscillating shape of the plurality of segments.

2. The device of claim 1, wherein the at least one pair of front legs being further defined as at least two pair of legs and wherein at least one pair of legs are configured to cause the front segment to repeatedly hop as the rotational motor rotates the eccentric load.

3. The device of claim 1, wherein multiple intermediate segments are consecutively included between the front segment and the intermediate leg segment.

4. The device of claim 1, wherein multiple segments are consecutively included after the intermediate leg segment.

5. A mechanical device comprising:

a plurality of segments interconnected consecutively at a pivot formed between two adjacent segments, the plurality of segments further defining at least a front segment, a rear segment, and at least one intermediate segment;

a rotational motor and an eccentric weight secured about one segment, of the plurality of segments, and wherein the rotational motor is adapted to rotate the eccentric weight to create vibration forces in a portion of the device, and at least one pair of legs extending from one segment, of the plurality of segments, towards a contact surface, defining a front leg segment, and wherein each of the legs from the front leg segment has a leg base and a leg tip at a distal end relative to the leg base and wherein each of the legs from the front leg segment is constructed from a flexible material and each of the legs from the front leg segment has an average axial cross-section of at least five percent of a length of the leg between the leg base and the leg tip, and the front leg segment is configured, as described herein, such that when the rotational motor generates a force that is directed downward and is suitable to deflect each of the legs from front leg segment to cause the front leg segment and thus the mechanical device to move in a substantially forward direction generally defined by an offset between the leg base and the leg tip and wherein as the vibration forces act to move the front segment substantially forward, the vibration forces further cause the rear and at least one intermediate segments being interconnected consecutively at the pivots to move in varying directions causing a continuously oscillating shape of the plurality of segments.

6. The mechanical device of claim 5 further comprising:

at least a second pair of legs extending from another segment, of the plurality of segments, towards a contact surface, and defining a second leg segment.

7. The mechanical device of claim 6, wherein the second leg segment and the front leg segment are interconnected to one another by having at least one other segment positioned therehetween.

8. The mechanical device of claim 6, wherein the front leg segment includes two pairs of legs.

9. The mechanical device of claim 8, wherein the two pairs of legs in the front leg segment form two rows of legs, and each row of legs extends from the front leg segment towards the surface.

10. The mechanical device of claim 9, wherein the two rows of legs are interconnected to one another by a saddle bar extending transversely across the front leg segment and over rotational motor.

11. The mechanical device of claim 10, wherein the legs extend through openings in a lower portion defined in the front leg segment.

12. The mechanical device of claim 6 further comprising a power source and a switch, the switch interconnecting the power source to the rotational motor for selectively providing power to activate and deactivate the rotational motor.

13. The mechanical device of claim 12, wherein the power source is positioned in a segment, of the plurality of segments, defining a power source segment.

14. The mechanical device of claim 13, wherein the power source segment is interconnected between the front leg segment and the second leg segment.

15. The mechanical device of claim 14, wherein the switch is positioned in a segment, of the plurality of segments, defining a switch segment.

16. The mechanical device of claim 15, wherein additional segments are positioned between the switch segment and the second leg segment.

17. The mechanical device of claim 16, wherein additional segments are positioned between the second leg segment and the rear segment.

18. The mechanical device of claim 5, wherein each segment includes a housing formed by top and bottom sections being interconnected therewith.

19. The mechanical device of claim 18, wherein each section of the housing includes a front portion and a rear portion, and the rear portion includes a perimeter smaller than the front portion.

20. The mechanical device of claim 19, wherein when a segment is interconnected to a subsequent segment, the rear portion of the housing of said segment is received into an opening defined in the front portion of the said subsequent segment.

21. A mechanical device comprising:

a plurality of segments interconnected consecutively, the plurality of segments further defining at least a front segment and a rear segment;

a rotational motor and an eccentric weight secured about one segment, of the plurality of segments, and wherein the rotational motor is adapted to rotate the eccentric weight to create vibration forces in a portion of the device, and at least one pair of legs extending from one segment, of the plurality of segments, towards a contact surface, defining a front leg segment, and wherein each of the legs from the front leg segment has a leg base and a leg tip at a distal end relative to the leg base and wherein each of the legs from the front leg segment is constructed from a flexible material and each of the legs from the front leg segment has an average axial cross-section of at least five percent of a length of the leg between the leg base and the leg tip, and wherein the rotational motor generates a force that is directed downward and is suitable to deflect each of the legs from the front leg segment to cause the front leg segment and thus the mechanical device to move in a substantially forward direction generally defined by an offset between the leg base and the leg tip and wherein as the vibration forces act to move the front leg segment substantially forward, the vibration forces further cause the rear segment being interconnected consecutively to move in a varying direction causing a continuously oscillating shape of the plurality of segments.

22. The mechanical device of claim 21, wherein the pair of legs in the front leg segment and the rotational motor and eccentric weight are positioned about the same segment.

23. The mechanical device of claim 22 further comprising:

at least another pair of legs extending from another segment, of the plurality of segments, towards a contact surface, to define a second leg segment.

24. The mechanical device of claim 23 further comprising additional segments interconnected between the first leg segment and the second leg segment.

25. The mechanical device of claim 24, wherein the plurality of segments are configured to vary the direction of the first and second leg segments as the rotational motor generates vibrational forces, and the varying directions of the first and second leg segments causes two or more segments of the body to oscillate from side to side.

26. A mechanical device comprising:

an elongated body defining a head section, a tail section, an intermediate section, a first interposed section defined between the head section and the intermediate section, and a second interposed section defined between the intermediate section and the tail section;

a rotational motor and an eccentric weight secured about one section of the body, and wherein the rotational motor is adapted to rotate the eccentric weight such that a vibrational force is directed through the body;

a first pair of legs extending from one section of the body towards a contact surface, defining a first leg segment, and wherein each of the legs from the first leg segment has a leg base and a leg tip at a distal end relative to the leg base and wherein each of the legs from the first leg segment is constructed from a flexible material and each of the legs from the first leg segment has an average axial cross-section of at least five percent of a length of the leg between the leg vase and the leg tip, such that the first leg segment is configured to cause the body to move in a direction caused by the vibrational forces; and a second pair of legs extending from the intermediate section towards a contact surface, and defining a second leg section, and wherein the first pair of legs are further configured to move the first leg section in a forward direction generally defined by an offset between the leg base and the leg tip as the rotational motor generates the vibrational forces, and the and wherein as the vibrational force acts to move the front leg segment substantially forward, the vibrational force further causes the tail and intermediate sections being interconnected consecutively to move in a varying direction causing a continuously oscillating shape of the elongated body.

27. The mechanical device of claim 26, wherein the body is configured to include a flexible characteristic defined at least between the head section, tail section, intermediate section, first interposed section, and the second interposed section.

28. The mechanical device of claim 27, wherein the flexible characteristic is further defined as a plurality of segments interconnected consecutively at pivots formed between two adjacent and interconnected segments.

29. The mechanical device of claim 26, wherein the first pair of legs and the rotational motor and eccentric weight are positioned about the head section.

30. The mechanical device of claim 26 further comprising a weight positioned within one or more sections.

31. The mechanical device of claim 30, wherein the weight is fixed into a position within the one or more sections.

32. The mechanical device of claim 30, wherein the weight is capable of shifting during movement of the one or more sections.

* * * * *